US005678789A

United States Patent [19]

Pipich

[11] Patent Number: 5,678,789

[45] Date of Patent: Oct. 21, 1997

[54] MODEL RAILROAD CAR POSITION INDICATOR

[76] Inventor: Robert B. Pipich, 1808 Shirley Rd., Lancaster, Mass. 01523

[21] Appl. No.: 567,472

[22] Filed: Dec. 5, 1995

[51] Int. Cl.[6] ..... B61L 27/00

[52] U.S. Cl. ..... 246/3; 246/33; 246/122 R; 246/122 A; 246/187 B; 246/246; 246/247; 246/255; 104/296; 104/298; 104/DIG. 1

[58] Field of Search ..... 246/3, 4, 6, 33, 246/62, 77, 122 R, 122 A, 178, 187, 187 B, 292, 246, 247, 255, 473 A; 104/53, 296, 298, DIG. 1

[56] References Cited

U.S. PATENT DOCUMENTS

| | | | |
|---|---|---|---|
| 3,179,063 | 4/1965 | Case et al. | 246/255 |
| 3,219,816 | 11/1965 | Albertson, Jr. et al. | 246/255 |
| 3,553,450 | 1/1971 | Ernst | 246/32 |
| 3,556,236 | 1/1971 | Cory et al.. | 177/163 |
| 3,659,725 | 5/1972 | Passalacqua | 213/75 TC |
| 3,707,124 | 12/1972 | Peterson | 104/26 R |
| 3,941,338 | 3/1976 | Knudsen | 246/77 |
| 4,128,218 | 12/1978 | Pohlig | 246/77 |
| 4,216,871 | 8/1980 | Rocereta | 213/211 |
| 4,335,820 | 6/1982 | Gramera | 213/75 TC |
| 4,349,196 | 9/1982 | Smith, III et al. | 246/247 |
| 4,355,776 | 10/1982 | Rydin | 246/415 A |
| 4,369,943 | 1/1983 | Hussein | 246/473 A |
| 4,613,103 | 9/1986 | Waranowitz | 246/473 A |
| 5,174,216 | 12/1992 | Miller et al. | 104/296 |
| 5,417,388 | 5/1995 | Stillwell | 246/122 R |
| 5,555,815 | 9/1996 | Young et al. | 104/296 |

*Primary Examiner*—S. Joseph Morano
*Attorney, Agent, or Firm*—Hamilton, Brook, Smith & Reynolds, P.C.

[57] ABSTRACT

A model railroad car position indicator includes a sensor receptive to the presence of a model railroad car on a track. Control circuitry determines the location of the car relative to a predetermined position on the track and approves initiation of a model train process if the car is within a range of acceptable positions for initiating the process. A preferred embodiment includes circuitry for determining whether the car velocity is less than a predetermined threshold velocity. In this embodiment, approval of initiation of the model train process is conditioned on both the car position being acceptable and the car velocity being acceptable. An indicator provides feedback to the model train operator for manual initiation of the model train process. Alternatively, the control circuit may automatically initiate the process.

19 Claims, 10 Drawing Sheets

MODEL RAILROAD CAR POSITION INDICATOR

BACKGROUND OF THE INVENTION

For model train enthusiasts worldwide, a common objective is to simulate the operations of full-scale railroads. To accomplish this objective, components of the model train set should be as realistic as possible. The components include engines, railroad cars, switches, signals, and other mechanisms which imitate full-scale railroads.

A model train operator monitors and controls the various actions of the model railroad from a centralized control panel or a remote controller. Many operations require accurate positioning of the train cars relative to remote control electromagnetic actuators and/or operating accessories. For example, uncoupling of cars requires that a metallized disk on the drawbar of each car be properly positioned relative to the electromagnetic actuator. Loading and unloading cargo to or from a stationary operating accessory requires that the car body be in correct alignment with that accessory. Other cars known as 'operating cars' are employed to produce simulated actions. The operating car commonly includes a plunger comprising a metallized bar, which mechanically reacts to a magnetic field by initiating a process in the car. The plunger is activated by an electromagnetic actuator located at a predetermined position along the track. Accurate positioning of the plunger relative to the electromagnetic actuator is critical for realizing the expected action of the car.

Presently, to accomplish the accurate positioning required for coupling and recoupling, the operator moves the cars into an estimated position near the electromagnetic actuator. Stopping the cars so that they are correctly positioned relative to the electromagnet for uncoupling or other process is difficult, as the train blocks the electromagnet from view. The operator may be across the room from the area of concern, which increases positioning difficulty. This forces the operator to blindly shift the intended cars back and forth in the section of track that includes the electromagnetic actuator. The train must be stopped and the electromagnet activated each time until the objective is achieved. This is not a very realistic simulation of the action of full-scale trains and therefore, the objectives of the model train enthusiast are not realized by this procedure.

SUMMARY OF THE INVENTION

The present invention is directed to an apparatus and method for determining whether a model train is in an appropriate position for initiating a simulated realistic action or process. The invention overcomes the limitations of prior art procedures by providing accurate feedback to the operator, permitting the operator to precisely determine the position of the train so that he can initiate a desired process.

In one aspect of the invention, a sensor is responsive to the presence of a model train on a track. Control circuitry is in communication with the sensor. The control circuit determines the location of the train relative to a predetermined position on the track, and approves initiation of a process if the train is within a range of acceptable positions for initiating the process.

In another aspect of the invention, the control circuit includes circuitry for determining whether the model train velocity is less than a predetermined threshold velocity. In a preferred embodiment, the approval by the control circuit of initiation of a process is conditioned on both the train position being acceptable and the train velocity being acceptable.

In another aspect of the invention, a position indicator provides feedback to the operator when the controller approves the initiation of the train process. The feedback may comprise visual or audio feedback. A warning indicator may be included for warning the operator that the car is nearly in position for a desired train process.

In a preferred embodiment of the invention, the sensor system comprises at least one sensor mounted on an insert adapted to be snapped onto a section of model train track. The sensors may spatially align with a corresponding plurality of model train wheels on a single train car or may align with a corresponding plurality of train wheels on adjacent train cars. When all sensors are simultaneously activated, the controller determines that the car/cars are in position. A sensor may also count trucks as they pass to determine car location.

The sensors may comprise conductive contacts adapted to communicate electrically with a model train wheel. The train wheel completes an electrical circuit between the model train rail and the conductive contact as the wheel traverses the conductive contact. Alternatively, the sensors may comprise electrical, optical, mechanical, magnetic, or acoustic switches.

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

BRIEF DESCRIPTION OF THE DRAWINGS

FIG. 5A is a schematic diagram of direction sensor circuitry. FIG. 5B is a schematic diagram of velocity sensor circuitry. FIG. 5C is a schematic diagram of position sensor circuitry.

FIG. 7A illustrates alignment of the position sensors relative to the electromagnet actuator for uncoupling two adjacent cars. FIG. 7B illustrates alignment of the position sensors relative to the electromagnet actuator for initiating a model train process on an operating car. FIG. 7C illustrates alignment of the position sensors relative to a predefined position on the track corresponding to an operation accessory for loading cargo onto a standard cargo car.

DETAILED DESCRIPTION OF THE INVENTION

The model railroad position indicator of the present invention provides feedback to a model railroad operator that an individual car or plurality of cars are in an appropriate position for initiating a model train process. The feedback provided by the invention is a realistic way to control the various operations of the model railroad. The invention eliminates guesswork involved in determining the position of a model train car relative to an electromagnetic actuator, operating accessory, or other important track location. The present invention enables the operator to simply guide the train into position while an indicator informs the operator of accurate positioning.

The apparatus of the invention includes a position sensor coupled to a control circuit. The position sensor generates a signal when the car is in position for an operator action. The control circuit receives the position signal and energizes a position indicator which provides feedback to the operator that the car is in position for initiating a model train process.

In a preferred embodiment, the position indicator is enabled and disabled by a velocity sensor which determines whether the train is traveling slowly or is stopped. Otherwise, the train would activate the position indicator each time a car satisfies the position criteria at the position sensors. This would cause the indicator to be activated several times per second if the train is traveling at a fast velocity creating an unrealistic simulation of actual railroad operation. To improve this situation, the control circuit may include circuitry which enables the position indicator only when the train is traveling at a velocity which is less than a predetermined threshold velocity and it is clear that the operator intends on initiating a desired process.

As described above, without the advantage of the present invention, the operator wishing to decouple cars or otherwise perform a model train process must visually align the car trucks with the electromagnet actuator. This requires visual surveillance of the actuator and meticulous control of the model train velocity and position. The present invention removes the guesswork required by the operator and provides visual feedback through an indicator lamp of when the train is in position for decoupling. This allows the operator to initiate the process from a remote location and eliminate the problems associated with current procedures.

Figure 1:
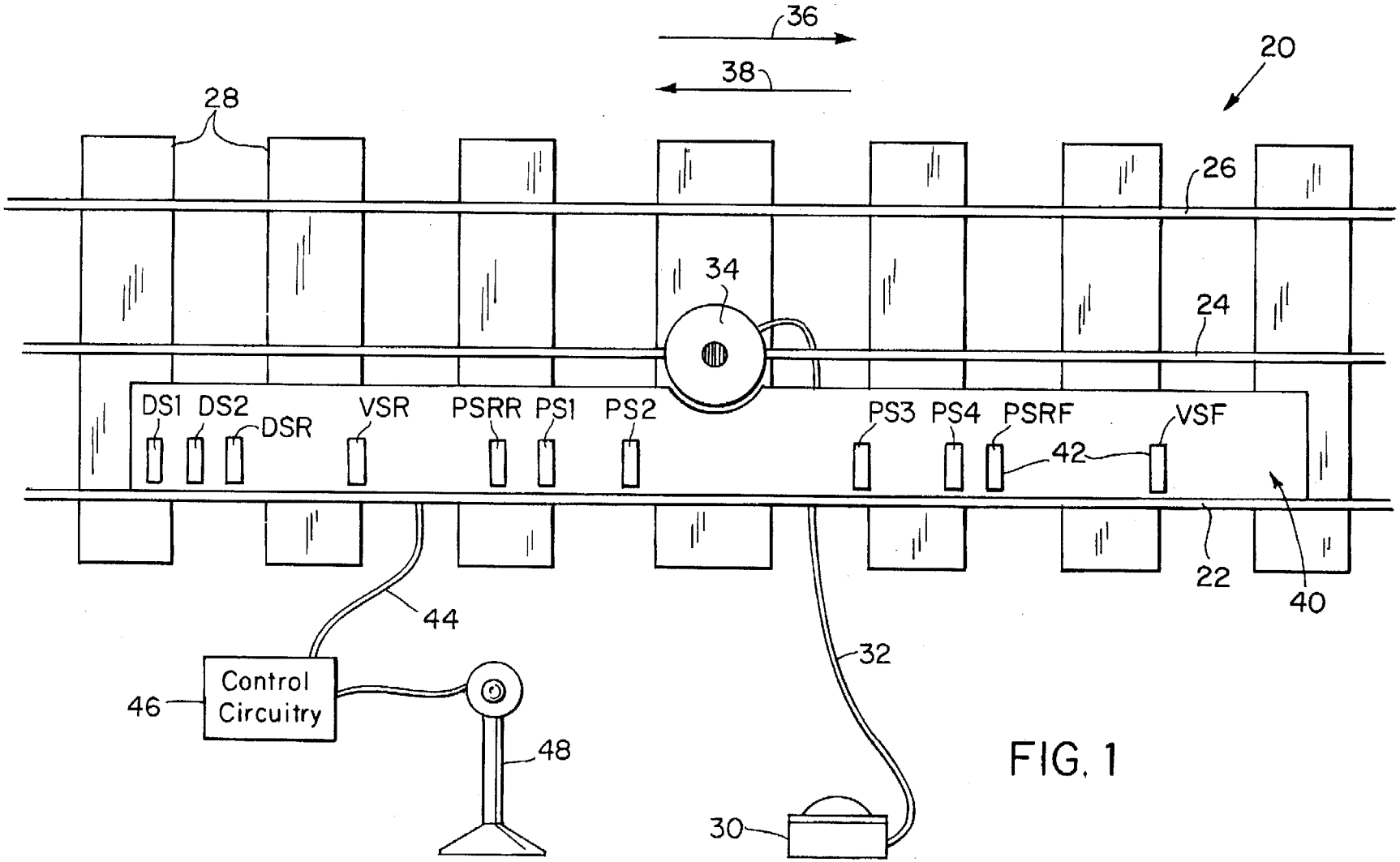
FIG. 1 is a top view of a model railroad position indicator in accordance with the present invention.

FIG. 1 is a top view of a model railroad position indicator in accordance with an embodiment of the present invention. A section of model railroad track 20 comprises railroad ties 28, first and second ground rails 22, 26, and a power or "hot" rail 24 tied to the train velocity controller (0–18 Volts AC). The section of track 20 shown is known in the art as an "uncoupling track", "remote control track", or "operating track" as it includes an electromagnet 34 remotely connected by a wire 32 to a decoupling switch 30 controlled by the operator (not shown). The decoupling magnet 34 is electrically insulated from the hot rail 24 and when activated by the operator, engages a metallized disc, armature plate, or plunger attached to a car located near the magnetic field generated by the electromagnet.

The position indicator includes a sensor strip 40, a control circuit 46, and an indicator lamp 48. The sensor strip 40 is preferably a plastic insert which snaps onto the remote control track 20. An array of sensors 42 on the strip 40 sense the position of the train relative to the electromagnet actuator 34, the velocity of the train, and the direction of travel. The sensors 42 are electrically coupled to the controller 46 via a sensor cable 44.

The sensor array 42 for the embodiment shown comprises: direction sensors DS1, DS2, DSR; velocity sensors VSR, VSF; and position sensors PS1, PS2, PS3, PS4, PSRR, PSRF. The direction sensors determine whether a train is traveling in a forward or reverse direction. For purpose of illustration, a forward direction of travel is defined as travel from the left side of the page to the right as indicated by arrow 36, and a reverse direction of travel is defined as travel from the right side of the page to the left as indicated by arrow 38.

The velocity sensors VSR, VSF enable the controller 46 to sense the velocity of the passing train. The controller 46 determines whether to accept the forward velocity sensor VSF or the reverse velocity sensor VSR depending on the direction of travel determined by the direction sensors. Each time a train wheel activates a velocity sensor VSF, VSR, the signal triggers a preset timer to start timing. Subsequent train wheels reset the timer to begin again. If the timer "times-out", then the control circuit 46 interprets this as an indication that a train wheel has not passed recently, and therefore the train is travelling at a slow velocity. In response, the controller 46 enables activation of the indicator lamp 48 by the wheel position sensors PS1–4.

The wheel position sensors PS1, PS2, PS3, PS4 align with the wheels of model train cars. Assuming that the train is traveling in a forward direction 36, if a train wheel sequentially triggers all four position sensors PS1, PS2, PS3, PS4 without triggering the forward position sensor reset PSRF, then the control circuit 46 determines that the train is in position for operator action. If the train is in position and the train velocity is slower than threshold, then the control circuit activates the indicator lamp 48, providing visual feedback to the operator that the train is in position for initiating a train process.

Figure 2:
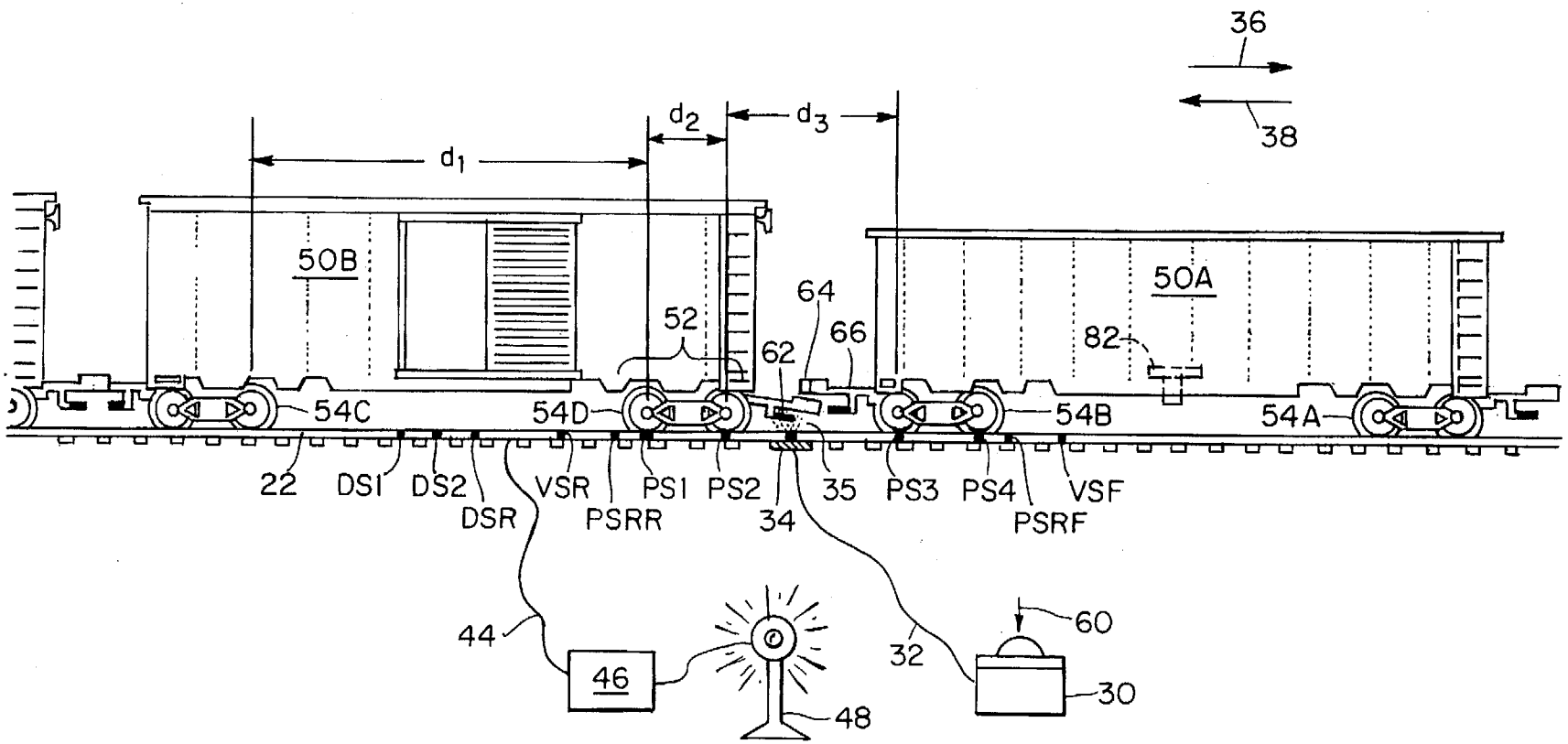
FIG. 2 is a side view of a model railroad position indicator in accordance with the present invention demonstrating decoupling of model train cars following determination that the cars are in appropriate position for decoupling.
Figure 4:
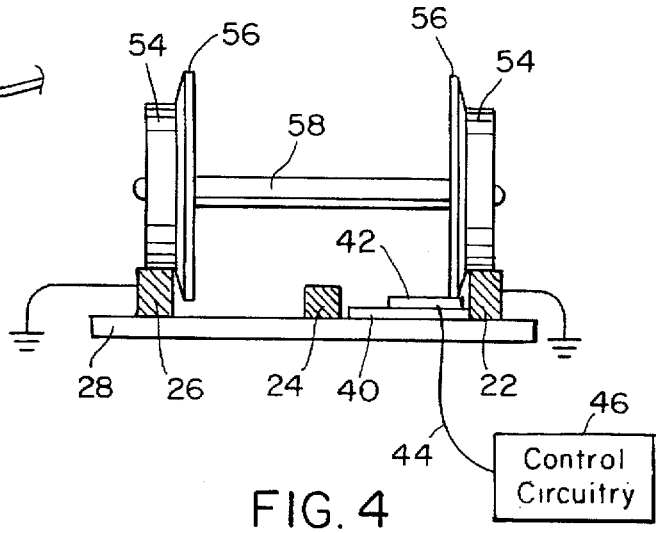
FIG. 4 is an endwise view of a model railroad car wheel completing an electrical circuit between a grounded rail and a sensor comprising a conductive contact.

FIG. 2 is an illustration of the present invention applied to provide feedback to the operator for uncoupling cars. Each pair of train wheels 52 is coupled by an axle 58 as shown in FIG. 4. A pair of axles is coupled to a truck 52. Each truck 52 includes a drawbar 66 having a knuckle coupler 64 at a distal end. The knuckle coupler 64 is spring-biased in a horizontal position such that when two separated cars 50A, 50B come into contact, the knuckle couplers 64 engage, coupling the cars 50A,50B together. For uncoupling the cars, a metallized disk 62 is attached to each truck drawbar 66. If the disc 62 is in the vicinity of the electromagnetic field 35 generated by the electromagnet 34, the disc 62 is pulled downward along with the drawbar 66 as shown in FIG. 2. This causes the knuckle couplers 64 to uncouple.

When the control circuit 46 determines that the cars 50A,50B are in position for uncoupling, it activates the indicator lamp 48. In response, the operator engages the switch 30 as shown by arrow 60, uncoupling the cars 50A,50B. The operator then initiates motion in the train to cause the first car 50A to move in the forward direction 36, while the second car 50B and any cars attached to it 50C remain behind.

Modern model train manufacturers generally comply with standards for the dimensions of model train cars and tracks, etc. Therefore, the distance $d_1$ between wheels 54 on adjacent trucks 52 on a single car 50B, the distance $d_2$ between wheels 52 on a single truck, and the distance $d_3$ between adjacent wheels 54 on adjacent trucks 52 on adjacent cars 50A,50B are generally predictable for a given type of car. Using this information, an array of wheel position sensors, for example, PS1–PS4 can be positioned to comply with these standards.

Figure 7A:
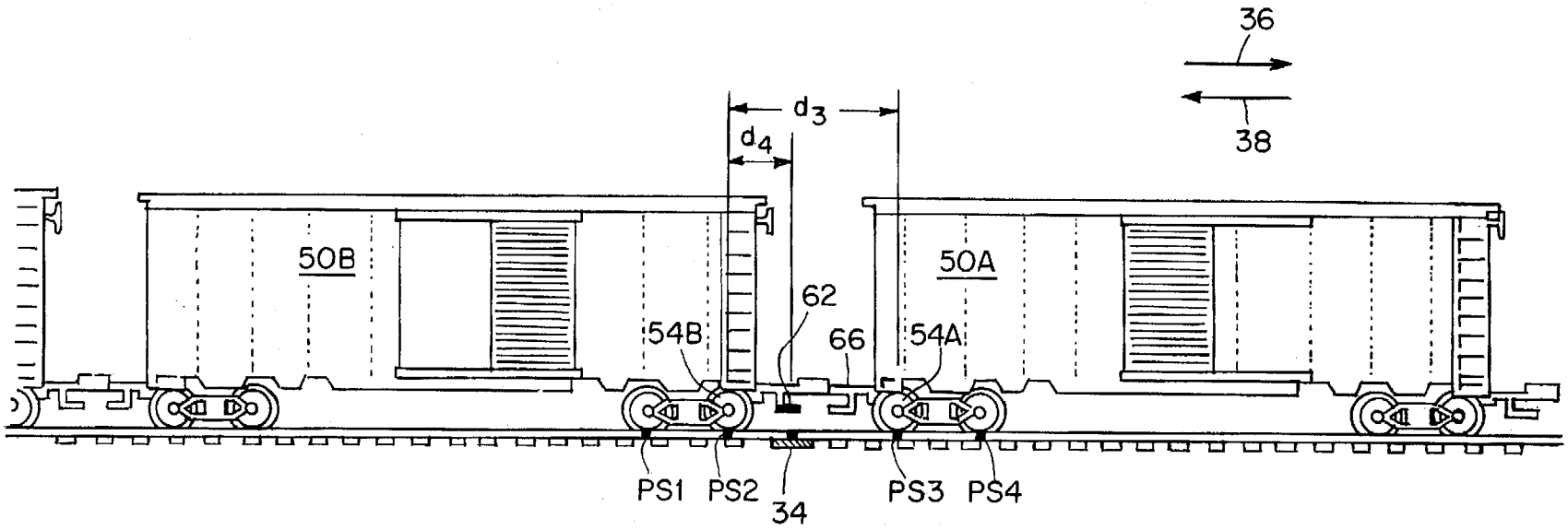
FIGS. 7A–7C illustrate alignment of the position sensors for various train processes.
Figure 7B:
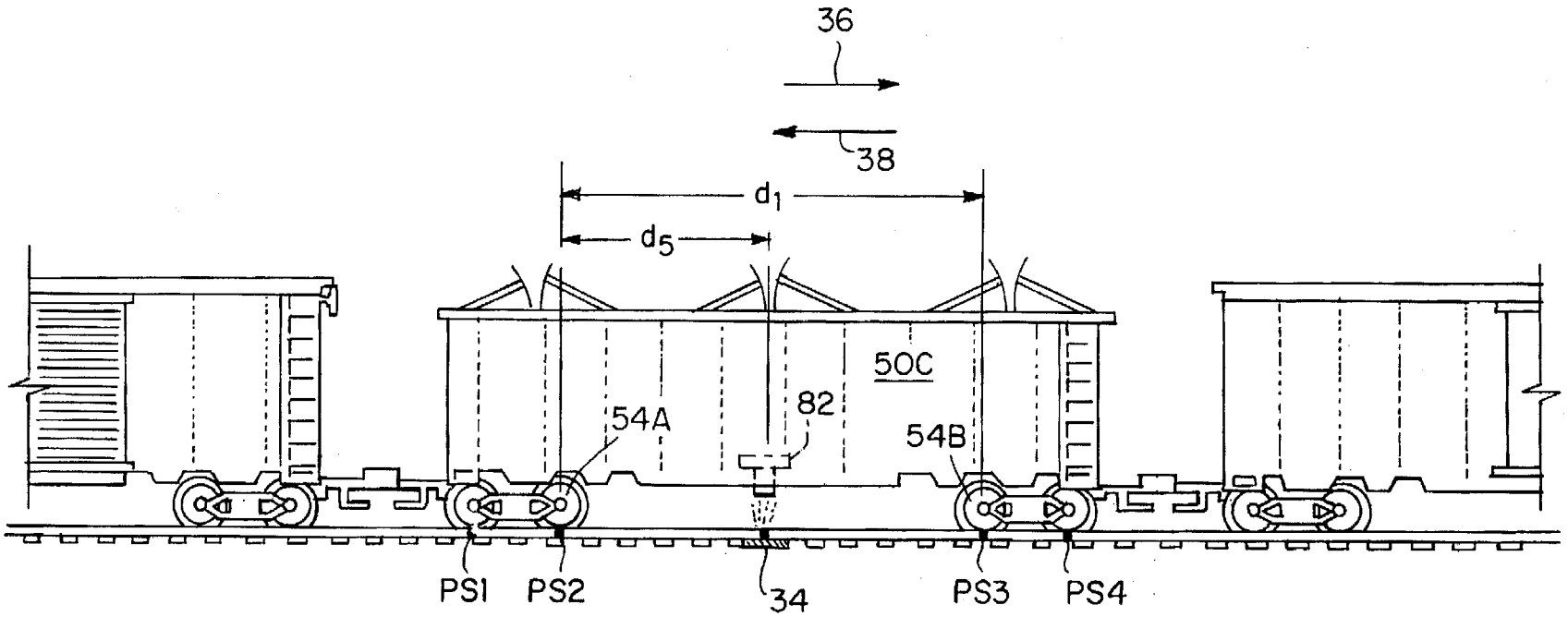
Figure 7C:
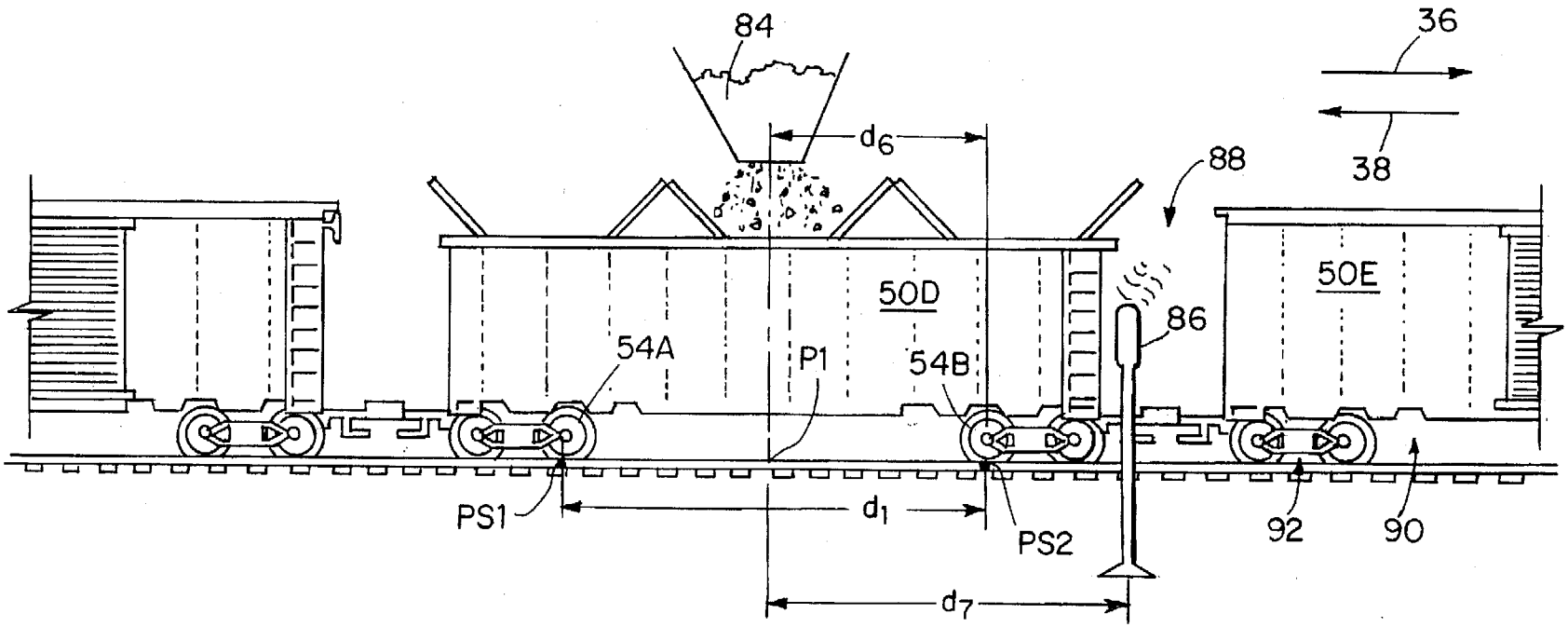

FIGS. 7A–7C illustrate alignment of position sensors PSx for various applications of the present invention. In these applications, the control circuit 46 determines the position of the cars by detecting sequential triggering of the position sensors PS1–PS4 by a train wheel. Alternatively, the position sensors PS1–PS4 may be disposed to spatially align with a plurality of train wheels on a single car or adjacent cars. In the alternative embodiment, the control circuit decides if the array of position sensors PS1–PS4 are simultaneously triggered by train wheels for determining whether the car or cars are in position for approving initiation of a model train process. The embodiments described in conjunction with FIGS. 7A–7C below are applicable to both sequential and simultaneous position sensor triggering.

FIG. 7A illustrates alignment of the position sensors PS1–PS4 relative to an electromagnet actuator 34 for uncoupling two adjacent cars 50A,50B. Wheel 54B is a predictable standard distance $d_4$ from the metallic uncoupling armature 62 on the drawbar 66. In view of this, position sensor PS2 is positioned a distance $d_4$ from the electromagnet 34. Sensor PS3 is placed the standard distance $d_3$ (defined above) from sensor PS2 on an opposite side of the actuator 34 to sense the wheel 54A on car 50A before uncoupling. If additional position sensors PS1, PS4 are desired, they should be placed a distance $d_2$ (defined above) from PS2 and PS3 respectively. With the array of sensors, the control circuit 46 has knowledge of the position of the first car 50A and second car 50B and the metallic armature 62 relative to the electromagnetic actuator 34.

FIG. 7B illustrates alignment of the position sensors PS1–PS4 relative to an electromagnet actuator 82 for initiating a model train process on an operating car 50C. On an operating car, the plunger 82 is a predictable distance $d_5$ from an inner wheel 54A. In view of this, position sensor PS2 is positioned a distance $d_5$ from the electromagnetic actuator 34. Position sensor PS3 is placed the standard distance $d_1$ (defined above) from position sensor PS2 on an opposite side of the actuator to sense wheel 54B. Additional position sensors PS1 and PS4 may be added and placed as described above, if desired. With this array of sensors, the control circuit 46 has knowledge of the position of the plunger 82 on the operating car 50C relative to the actuator 34.

FIG. 7C illustrates alignment of the position sensors PS1, PS2 relative to a predetermined position $P_1$ on the track corresponding to an operation accessory for loading cargo, for example, coal 84, into a standard cargo car 50D. Wheel 54B is a predictable distance d6 from the coal-loading position on the car 50D. In view of this, position sensor PS2 is set the distance $d_6$ from location $P_1$. Position sensor PS1 is placed the standard distance $d_1$ (defined above) from PS2 to sense wheel 54A on car 50D before loading the car with coal. With this sensor array, the control circuit 46 has knowledge of the car 50D position relative to the coal loading position $P_1$.

Figure 3:
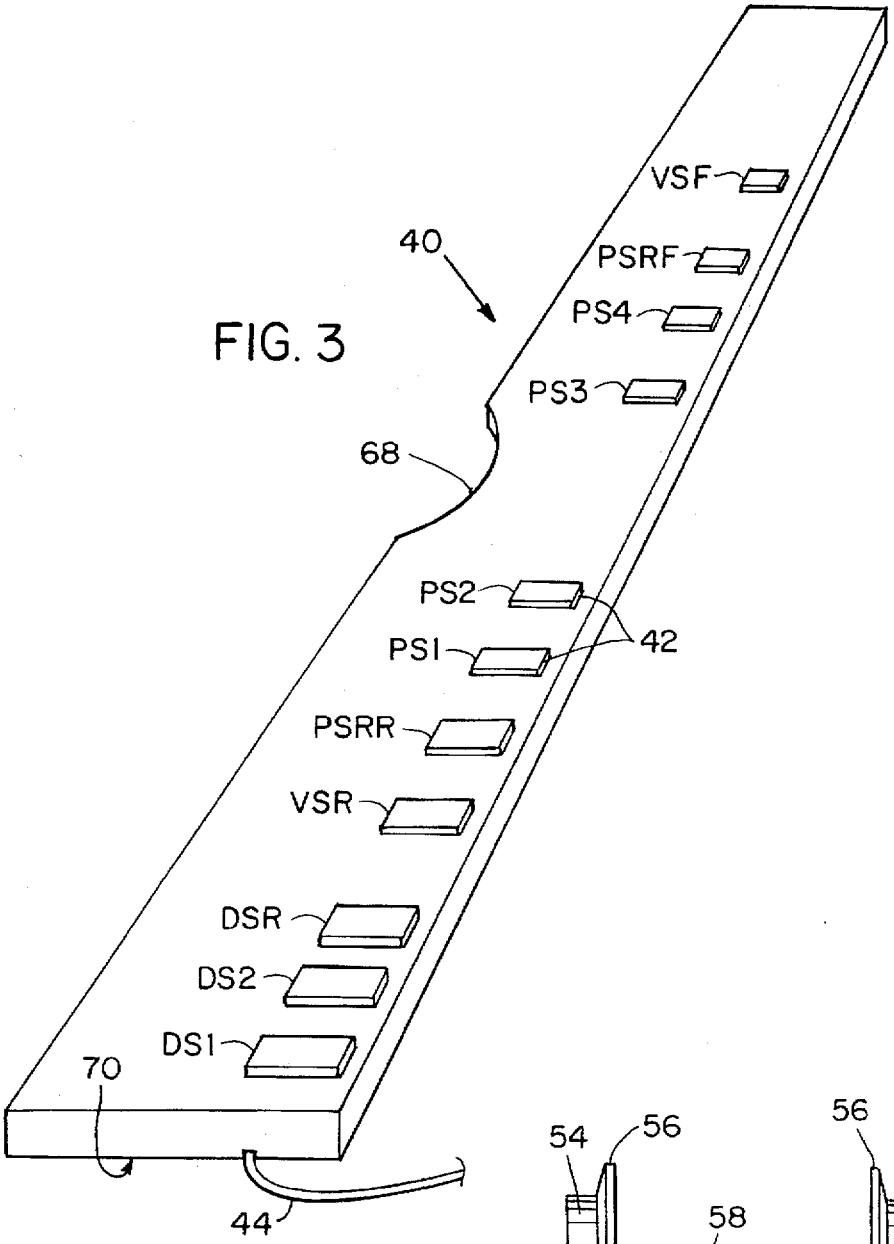
FIG. 3 is a perspective top view of a preferred embodiment of a sensor array insert in accordance with the present invention.

FIG. 3 is a perspective view of a preferred sensor strip 40 in accordance with the present invention. The strip 40 is attachable to a variety of model track configurations. For example, the strip 40 may be inserted on a standard two-rail or three-rail track, or any remote-control or operating track. The embodiment illustrated in FIG. 3 includes a groove 68 to accommodate an uncoupling electromagnet. The sensors 42 shown are raised bumps formed of conductive material which contact the flange of a train wheel as shown in FIG. 4 below. The sensors are individually coupled to a sensor cable 44 preferably from the bottom surface 70 of the plastic sensor strip 40.

In an alternative sensor strip embodiment, the strip may comprise a thin insulative film to be slipped over a rail. Sensors formed on the film electrically contact the train wheels as they traverse the film. The sensors are grounded by a conductive path through the axle from a wheel traversing the opposite rail.

FIG. 4 is an endwise view of a train wheel 54 engaging a sensor 42. A pair of train wheels 54 formed of electrically-conductive material is coupled by an axle 58. The wheels 54 ride on grounded outer rails 22, 26. A flange 56 on the inner surface of each wheel 54 is larger in radius than the wheel 54, preventing the wheels 54 from derailing. The sensor strip 40 is inserted between the power rail 24 and one of the ground rails 22. A sensor in the form of a metal contact 42 is electrically insulated from the ground 22 and power 24 rails. As the wheel 54 contacts the rail 22 in the vicinity of the sensor 42, the wheel flange 56 makes electrical contact with the sensor 42, grounding out the sensor 42 which is normally pulled high. Each sensor 42 is wired 44 to the control circuit 46 where sensor electronics are housed.

Figure 5A:
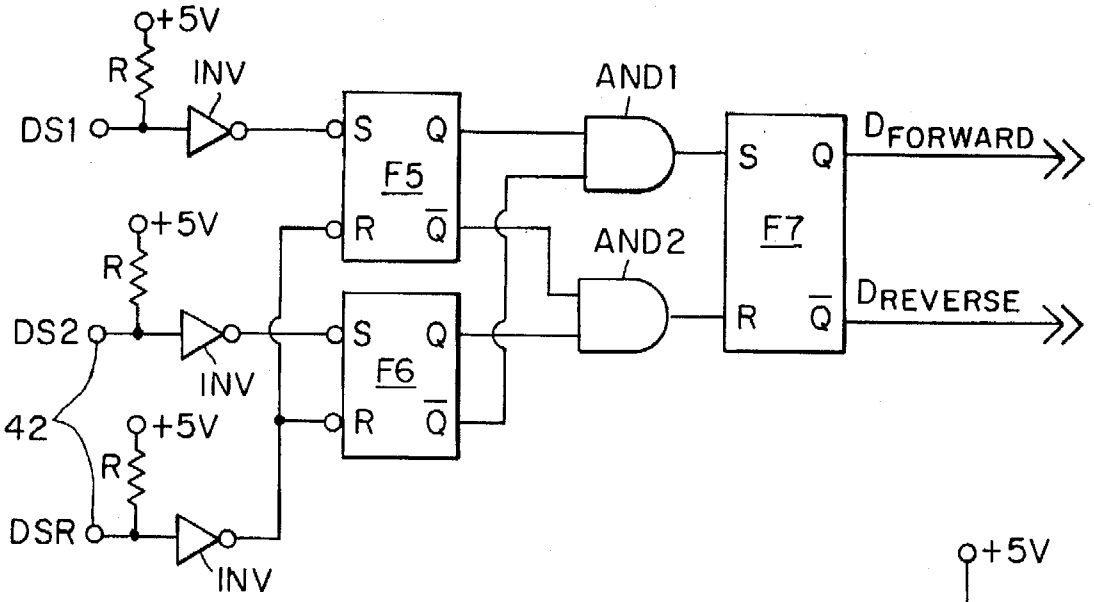
FIGS. 5A–5C are schematic diagrams of control circuitry for a preferred embodiment of the present invention.
Figure 5B:
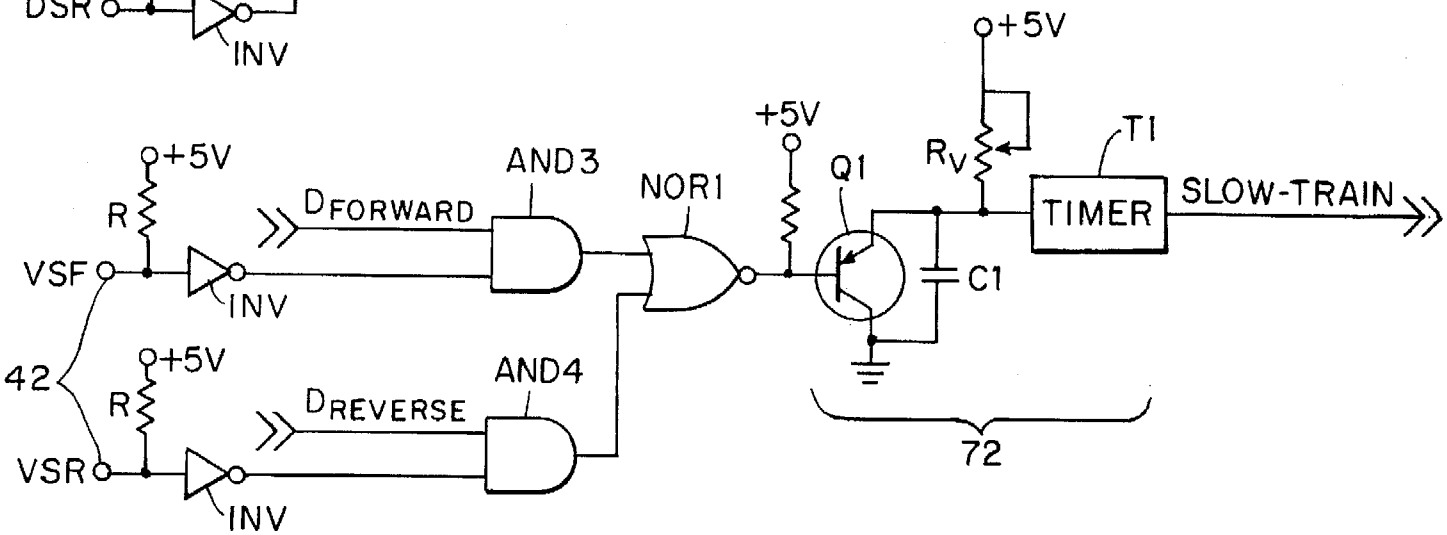
Figure 5C:
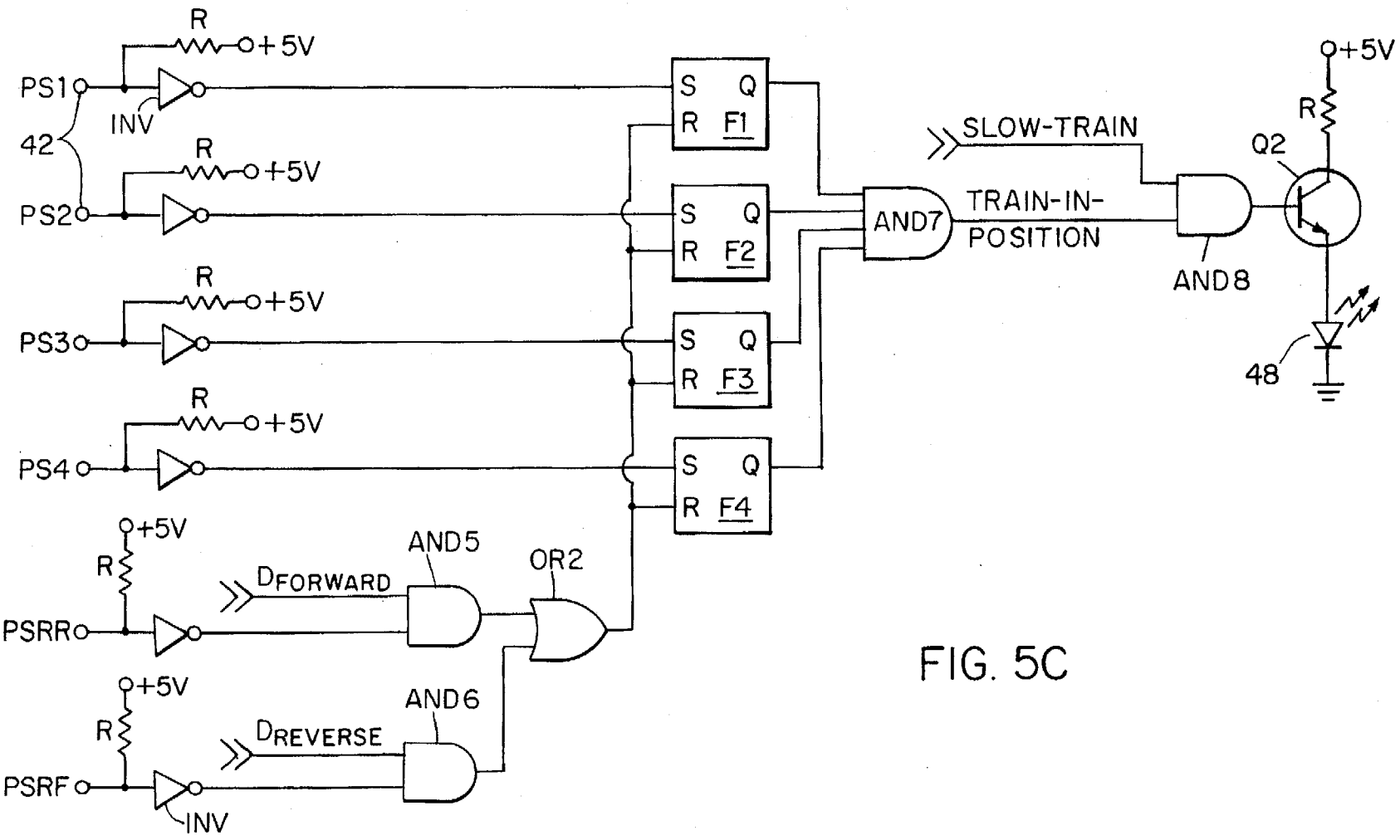

FIGS. 5A–5C are schematic diagrams of the direction sensor, velocity sensor and position sensor circuits respectively for a preferred embodiment of the invention. Each sensor 42 is electrically coupled to a pull-up resistor R tied to +5V DC and an inverter INV. When the sensor 42 is inactive, the signal feeding the inverter INV is TRUE and therefore, the output of the inverter is FALSE (where TRUE represents +5V DC and FALSE represents 0V DC). When a train wheel makes contact between the grounded rail and the sensor 42, the input to the inverter INV is FALSE and the output of the inverter is TRUE. FIG. 5A is a schematic diagram of direction sensor circuitry in accordance with the present invention. The circuit includes three inputs: direction sensor 1 DS1, direction sensor 2 DS2, and direction sensor reset DSR; and generates two outputs: forward direction $D_{forward}$, and reverse direction $D_{reverse}$. A pair of set/reset flip-flops F5, F6 are set by the direction sensors DS1, DS2 respectively and reset by the direction sensor reset DSR. When either flip-flop F5,F6 is set by DS1 or DS2, the output Q remains TRUE until the flop is reset by DSR. The output Q of each flop F5, F6 is ANDed with the inverted output $\overline{Q}$ of the opposite flop at AND gates AND1, AND2. The outputs of the AND gates AND1, AND2 are fed into a third set/reset flip-flop F7. The output Q of F7 represents the forward direction signal $D_{forward}$ and the inverted output $\overline{Q}$ of F7 represents the reverse direction signal $D_{reverse}$.

Activation of the DS1 sensor following a DSR signal will result in $D_{forward}$ being TRUE, and activation of DS2 sensor following a DSR signal will result in $D_{reverse}$ being TRUE. When $D_{forward}$ is TRUE, this indicates that the train is traveling in a forward direction and when $D_{reverse}$ is TRUE, this indicates that the train is traveling in a reverse direction. Assuming that the train is traveling in a forward direction, the train wheels trigger the direction sensors in the following order: DSR . . . DS1 . . . DS2 . . . DSR . . . DS1. This results in $D_{forward}$ remaining TRUE. When the train is traveling in a reverse direction, the sensors are triggered in reverse order: DSR . . . DS2 . . . DS1 . . . DSR . . . DS2. This results in $D_{reverse}$ remaining TRUE. The forward direction $D_{forward}$ and reverse direction $D_{reverse}$ signals are provided to the velocity sensing circuit and truck position sensing circuit for reasons discussed below.

FIG. 5B is a schematic illustration of velocity sensor circuitry. Two velocity sensors 42 are provided, one for the forward direction of travel VSF, and the other for the reverse direction of travel VSR. The forward velocity sensor VSF is enabled by an AND gate AND3 having an input tied to $D_{forward}$ if the train is traveling in a forward direction of travel. Likewise, the reverse velocity sensor VSR is enabled by an AND gate AND4 having an input tied to $D_{reverse}$ if the train is traveling in a reverse direction of travel. The outputs of the AND gates AND3, AND4 are combined at a NOR gate NOR1, the output of which is input to a timer circuit 72.

Assuming that the train is traveling in the forward direction of travel 36 at a relatively fast velocity, the forward velocity sensor VSF is repeatedly grounded by the passing train wheels, causing the output of the NOR gate NOR1, normally pulled TRUE by the pull-up resistor R, to repeatedly be FALSE. This repeatedly forward-biases the transistor Q1, causing the capacitor C1 to recharge. This repeatedly resets a standard timer T1, causing the timer output SLOW-TRAIN to remain FALSE. When the train is moving at a slower velocity, the forward velocity sensor VSF is activated less frequently if at all, and the timer T1 is permitted to time out, causing the timer output SLOW-TRAIN to become active, indicating that the train is at or near a complete stop as the operator guides it into position for operator action such as decoupling.

The timer circuit 72 controls the threshold velocity at which the indicator lamp is disabled. The R-C time constant of capacitor C1 and resistor $R_v$ can be changed to adjust the threshold velocity. The threshold velocity can be fixed or variable depending on the application.

Separate velocity sensors VSF, VSR are required for the forward and reverse directions of travel in this embodiment. Referring to FIG. 2 and assuming a forward direction of travel 36, it is apparent that the last time VSF was activated was when wheel 54A of car 50A engaged VSF. Car 50A then traveled a distance $d_1$ before wheel 54B approached the vicinity of sensor VSF. Before wheel 54B contacted VSF however, it engaged PS4 (as shown) and thus satisfied all conditions for indicating the cars 50A and 50B are in position for decoupling.

Assume now that the train is travelling in the reverse direction 38 and that VSF is the only velocity sensor. It is apparent that the last time VSF was true was when wheel 54B of car 50A engaged VSF. In this case, the cars 50A,50B travel a minimal distance $d_7$ before all position sensors PS1–4 are activated. The distance $d_7$ for the reverse direction of travel 38 is on the order of one tenth of the distance $d_1$, corresponding to the forward direction of travel 36. Thus, in the reverse direction the timer would not have "timed-out" even though the cars 50A,50B were in position to be uncoupled. The R-C time constant that was proper for the forward direction is improper for the reverse direction.

In view of this, to keep the R-C time constant the same for forward and reverse directions of travel, a second velocity sensor VSR is added. The second velocity sensor VSR is activated by the direction sensor circuit signal $D_{reverse}$ when the train is traveling in a reverse direction. In the reverse direction, when wheel 54C engages VSR the entire length $d_1$ of car 50B must pass before wheel 54D engages VSR. This allows for a longer R-C time constant in both directions of travel.

FIG. 5C is a schematic diagram of position sensor circuitry. Four position sensors Ps1–4, are activated by the presence of a train wheel. Each inverted sensor PS1–PS4 signal is fed into a set/reset flip-flop F1–F4. A train wheel sensed by the sensors PS1–PS4, sets the flip-flop F1–F4 outputs Q TRUE. The flop F1–F4 output remains TRUE until reset by the position sensor reset PSRF, PSRR. The forward position sensor reset PSRF is enabled by the AND gate AND6, having an input tied to $D_{forward}$, if the direction sensor circuit determines that the train is traveling in a forward direction, and the reverse position sensor reset PSRR is enabled by the AND gate AND5, having an input tied to $D_{reverse}$, if the direction sensor circuit determines that the train is traveling in a reverse direction.

Assuming that the flops F1–F4 are initially reset, a train traveling in the forward direction of travel will first trigger PS1, setting the output Q of F1 TRUE, followed by PS2, PS3, and PS4, setting the outputs Q of F2, F3, and F4 TRUE respectively. This causes the output signal TRAIN-IN-POSITION of the AND gate AND7 to be TRUE. If any of the flip-flop F1–F4 outputs Q are FALSE, then the output of the AND gate AND7 will also be FALSE. If the train is in proper position for operator action, that is the signal TRAIN-IN-POSITION is TRUE, and the velocity sensor circuit has determined that the train is slow, in other words, the signal SLOW-TRAIN is TRUE, then the output of the AND gate AND8 will be TRUE, forward-biasing transistor Q2, and enabling the indicator lamp 48.

This completes a description of the preferred embodiment of the invention. Alternative embodiments will hereinafter be described.

Figure 6A:
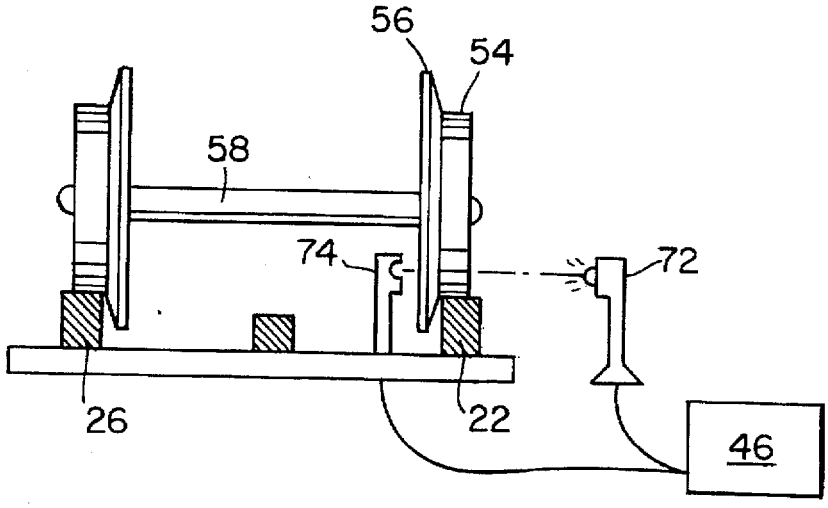
FIGS. 6A–6C are illustrations of optical, mechanical and acoustic sensor embodiments respectively.
Figure 6B:
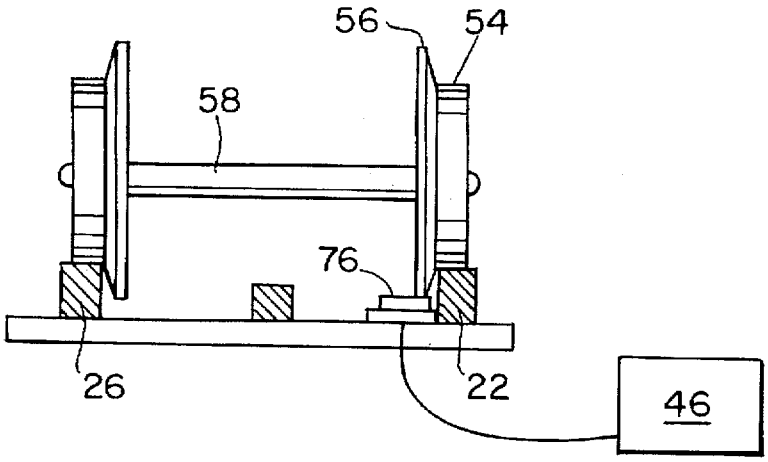
Figure 6C:
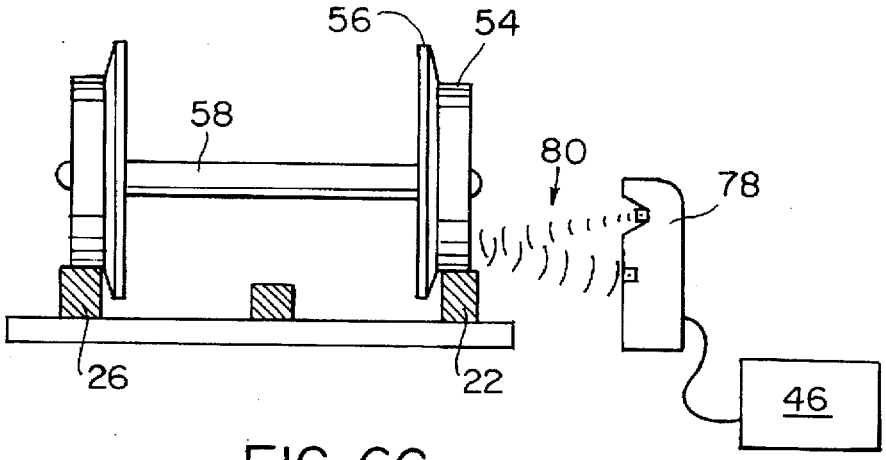

In an alternative embodiment, the sensors may comprise optical, magnetic, mechanical, or acoustic sensors, as shown in FIGS. 6A–6C respectively. In FIG. 6A, an infrared emitter 72 transmits an optical signal which is sensed by infrared detector 74 until a train wheel 54 breaks the path. In FIG. 6B, the wheel flange 56 triggers a mechanical or magnetic switch 76. In FIG. 6C, an acoustical sensor 78 transmits and receives a sound wave 80 which is reflected by the wheel 54.

A break-beam detector 86 as shown in FIG. 7C may be employed as an alternative to the train wheel sensors for determining the position and velocity of the model train cars. The detector 86, comprises a transmitter and receiver disposed on opposite sides of the track. The transmitter emits an electromagnetic beam of energy, for example light energy, which is normally received by the receiver. The body of a passing car 50E interferes with beam transmission. A gap 88 between the cars allows the beam to pass to the receiver, where it is detected. If the sensor is placed a known distance $d_7$ from the control location P1, proper positioning of the car 50D relative to the point of interest P1 can be determined. In addition to detecting the gaps 88 between cars, the break-beam detector may detect the gap 90 between trucks 90 or the gaps 92 between train wheels.

The sensors may be combined into a single "smart" sensor controlled by a microprocessor or microcontroller. The microprocessor could use time sharing techniques to perform position sensing, velocity sensing, and direction sensing with the single sensor. Furthermore, the sensors may communicate with the controller using various electromagnetic media, for example: DC or AC signals over wire, or ultraviolet or infrared radiation through air.

Figure 8A:
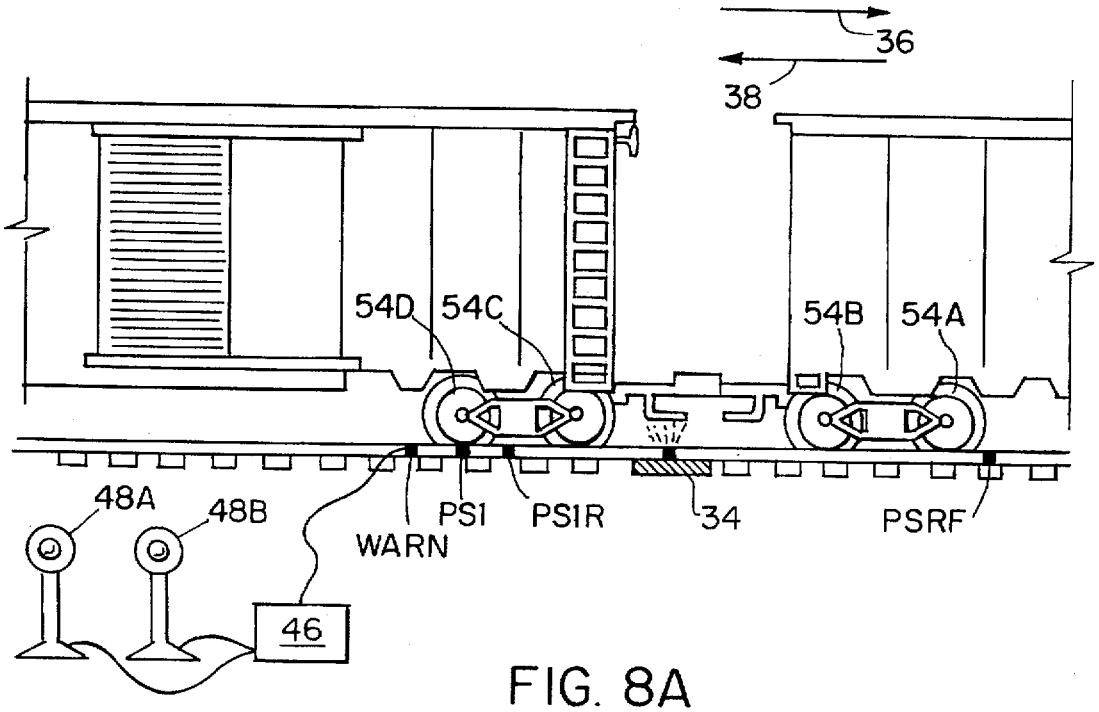
FIGS. 8A and 8B illustrate an alternative position sensor arrangement and a corresponding schematic, respectively.
Figure 8B:
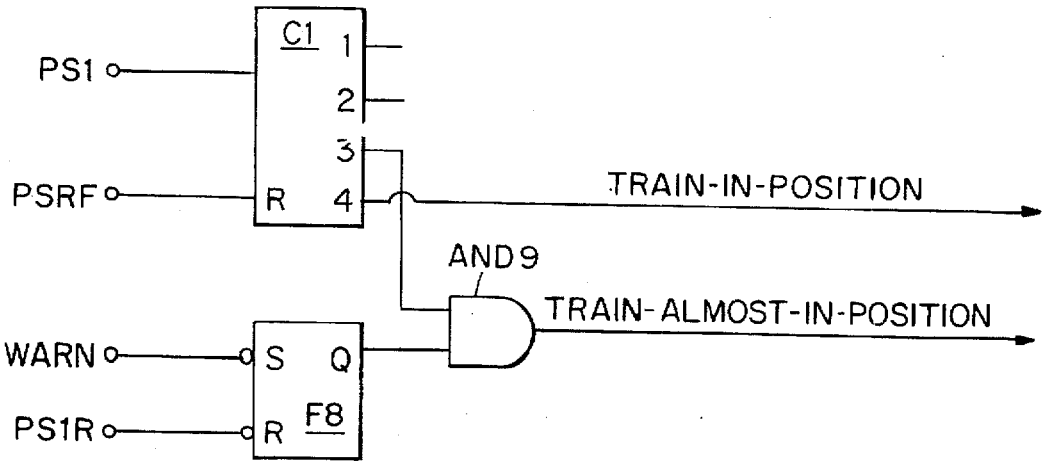

An example of a smart position sensor is shown in FIG. 8A and 8B. In FIG. 8A, the position sensor array comprises a wheel position sensor PS1, a warning sensor WARN, a wheel position sensor reset PS1R, and a forward position sensor reset PSRF. The control circuit 46 is programmed to count the number of times a train wheel 54A–54D triggers the wheel position sensor PS1. When a train wheel 54A triggers the forward position sensor reset PSRF, assuming that the train is traveling in a forward direction of travel, the control circuit 46 resets the counter. Upon counting the fourth wheel 54D, after wheels 54A, 54B, and 54C have already been sensed by the position sensor PS1, the control circuit 46 determines that the car is in position for operator action, and indicates this to the operator with the indicator lamp 48A.

A warning light may be included to indicate to the operator that the train wheels are almost in position for activation of a model train process, in order to enhance the operator's reaction time. The embodiment of FIG. 8A includes a warning sensor WARN which detects whether the train is almost in position for the process. For the warning light to be activated, two conditions must be met. First, the counter must determine that the third train wheel 54C has most recently triggered the position sensor PS1. Following this, when the fourth wheel 54D triggers the warning sensor WARN, the control circuit determines that the train is almost in position for operator action and indicates this to the train operator with a second indicator lamp, 48B.

FIG. 8B is a schematic illustration of a control circuit 46 for the smart position sensor array of FIG. 8A. The wheel position sensor signal PS1 triggers a counter C1 each time it is activated by a train wheel 54A–D. When the counter C1 counts to three without being reset by the forward position sensor reset PSRF, and the output Q of flip-flop F8 is set TRUE in response to the WARN sensor being triggered, then the output of AND gate AND9, TRAIN-ALMOST-IN-POSITION, is set TRUE. The wheel position sensor reset PSRF signal resets the warning flip-flop F8 just after each wheel 54A–54D triggers the PS1 sensor, preventing the warning light 48B from being activated over the entire distance between passage of wheels 54C and 54D. When the counter C1 counts to four without being reset by PSRF, the TRAIN-IN-POSITION signal is set TRUE. The TRAIN-IN-POSITION and TRAIN-ALMOST-IN-POSITION signals can be combined with the SLOW-TRAIN signal by the controller as described above in conjunction with FIG. 5 to activate the indicator lamps 48A,48B.

The invention is applicable to various model train scales, including: O, 027, S, Standard, G, HO, and others.

While this invention has been particularly shown and described with references to preferred embodiments thereof, it will be understood by those skilled in the art that various changes in form and detail may be made therein without departing from the spirit and scope of the invention as defined by the appended claims.

I claim:

1. Apparatus for determining if a model railroad car is in an appropriate position on a track for initiating a model train process comprising:

a sensor responsive to the presence of a model railroad car;

control circuitry in communication with the sensor for determining the location of the car relative to a predetermined position on the track and for approving initiation of the process if the car location is within a range of acceptable positions for initiating the process;

the control circuitry including circuitry for determining if the car velocity is less than a predetermined threshold velocity; and the control circuitry also including circuitry for conditioning approval of initiation of the train process if both the car location is acceptable and the car velocity is acceptable.

2. The apparatus of claim 1 further comprising a position indicator electrically coupled to the controller for providing feedback to a model train operator of the approval of initiation of the process by the control circuitry.

3. The apparatus of claim 2 wherein the feedback is in the form of visual or audio feedback.

4. The apparatus of claim 1 wherein the control circuitry further comprises circuitry for determining the direction of travel of the car.

5. The apparatus of claim 1 further comprising circuitry for automatically initiating the process in response to approval by the controller circuitry.

6. The apparatus of claim 1 wherein said sensor comprises a plurality of sensors spatially disposed to align with a corresponding plurality of car wheels.

7. The apparatus of claim 1 wherein the sensor type is selected from the group comprising: electrical, magnetic, optical, mechanical, and acoustic.

8. The apparatus of claim 1 wherein said sensor comprises a conductive contact adapted to communicate electrically with a car wheel, the wheel completing a circuit between the conductive contact and the track as the wheel traverses the conductive contact.

9. The apparatus of claim 1 wherein the control circuitry includes circuitry for determining whether the car location is nearly within the range of acceptable positions for initiating the process.

10. The apparatus of claim 1 wherein the sensor is responsive to the presence of model car trucks and wherein the control circuitry is adapted for counting the trucks to determine the location of the car.

11. A method for determining if a model railroad car is in an appropriate position for initiating a process comprising the steps of:

determining the location of a model railroad car relative to a predetermined position on a track with a sensor; and approving initiation of a model train process if the car location is within a range of acceptable positions for initiating the process; and the step of approving further comprising approving initiation of the process if both the car location is acceptable and the car velocity is acceptable.

12. The method of claim 11 further comprising the step of determining if the car velocity is less than a predetermined threshold velocity.

13. The method of claim 11 further comprising the step of indicating to an operator of the train, the approval of initiation of the process.

14. The method of claim 11 further comprising the step of initiating the process automatically in response to approval thereof.

15. Apparatus for indicating the position of a model railroad car on a track comprising:

a controller;

a velocity sensor responsive to the passage of the car in communication with said controller, said controller adapted to determine if the velocity of said car relative to said velocity sensor is less than a predetermined threshold velocity;

a position sensor in communication with said controller responsive to the presence of the car;

a position indicator in communication with said controller, said position indicator adapted to indicate if said car location is within a range of acceptable positions, said controller enabling said position indicator if said car velocity sensed by said velocity sensor is less than a predetermined threshold velocity.

16. The apparatus of claim 15 further comprising a direction sensor responsive to the passage of said car in communication with said controller; said controller determining the direction of travel of said car.

17. The apparatus of claim 16 wherein said velocity sensor comprises two velocity sensors, one velocity sensor for each direction of car travel, either velocity sensor being activated by said controller depending on the direction of car travel, as sensed by said direction sensor.

18. The apparatus of claim 15 wherein said position sensor comprises a plurality of sensors spatially disposed to align with a corresponding plurality of car wheels.

19. The apparatus of claim 18 wherein said controller determines the position of said car relative to said range of acceptable car positions in response to a plurality of position signals received from said plurality of sensors.

* * * * *